US007500675B2

(12) United States Patent
Sandman

(10) Patent No.: US 7,500,675 B2
(45) Date of Patent: Mar. 10, 2009

(54) PORTABLE DISC GOLF TARGET

(75) Inventor: Ian A. Sandman, Patchogue, NY (US)

(73) Assignee: Regent Sports Corporation, Hauppauge, NY (US)

( * ) Notice: Subject to any disclaimer, the term of this patent is extended or adjusted under 35 U.S.C. 154(b) by 0 days.

(21) Appl. No.: 11/873,130

(22) Filed: Oct. 16, 2007

(65) Prior Publication Data

US 2008/0139343 A1 Jun. 12, 2008

Related U.S. Application Data

(60) Provisional application No. 60/864,931, filed on Nov. 8, 2006.

(51) Int. Cl.
*A63B 67/06* (2006.01)

(52) U.S. Cl. ..... 273/400; 473/476

(58) Field of Classification Search ..... 273/398–402, 273/407; 473/479, 481
See application file for complete search history.

(56) References Cited

U.S. PATENT DOCUMENTS

| | | | | |
|---|---|---|---|---|
| 4,039,189 | A | 8/1977 | Headrick et al. | |
| 4,461,484 | A | 7/1984 | Headrick | |
| 4,792,143 | A | 12/1988 | Headrick | |
| 5,358,255 | A | 10/1994 | Jolson | |
| 5,868,395 | A | 2/1999 | Headrick | |
| 5,921,551 | A | 7/1999 | Dunipace | |
| 6,250,635 | B1 | 6/2001 | Chittenden | |
| 6,468,165 | B1 * | 10/2002 | Moore | 473/170 |
| 6,494,455 | B1 | 12/2002 | Headrick | |
| 6,554,285 | B2 | 4/2003 | Chittenden | |
| 6,776,417 | B1 * | 8/2004 | Holgate | 273/400 |
| 6,808,176 | B2 * | 10/2004 | Billig et al. | 273/400 |
| 6,948,713 | B1 | 9/2005 | Grunfeld | |
| 7,101,293 | B2 * | 9/2006 | Tarng et al. | 473/446 |
| D554,193 | S * | 10/2007 | Palmeri et al. | D21/305 |
| 2003/0025272 | A1 * | 2/2003 | Billig et al. | 273/400 |

* cited by examiner

*Primary Examiner*—Mark S Graham
(74) *Attorney, Agent, or Firm*—Darby & Darby P.C.

(57) ABSTRACT

A portable flying disc game includes a foldable base that can be pivotally attached to a first end of a vertical pole. A first basket member is removably coupled to the vertical pole above the foldable base, and includes a first part and a second part that are detachable from one another. The first part has a first coupling member that receives the vertical pole and a support flange for receiving and supporting the second part to form the assembled first basket member. A second basket member is also removably coupled to the vertical pole, and includes a frame having a first part and a second part to which ends of cords are coupled to so that the cords hang from the frame. A weighted member is coupled to the cords which serve to support and suspend the weighted member above the first basket.

17 Claims, 6 Drawing Sheets

PORTABLE DISC GOLF TARGET

CROSS-REFERENCE TO RELATED APPLICATION

The present application claims the benefit of U.S. provisional patent application Ser. No. 60/864,931, filed Nov. 8, 2006, which is hereby incorporated by reference in its entirety.

TECHNICAL FIELD

The present invention relates to a target for the game of flying disc golf and more particularly, to a portable target for flying disc golf. The new flying disc target assembly provides for effectively engaging and stopping the flight of a flying disc and allowing the disc to be dropped by gravity into an open top disc basket utilizing less weight than conventional flying disc targets.

BACKGROUND

Heretofore, there have been a variety of different types of flying disc targets and flying disc entrapment devices used in the game of flying disc golf. In U.S. Pat. Nos. 6,494,455, 5,868,395, 4,792,143, 4,461,484 and 4,039,189 to Headrick, the use of a pole mounted flying disc entrapment device is disclosed using a plurality of vertically mounted chains. The chains are used for engaging and entrapping a flying disc. The mounted chains are suspended above an open top basket mounted on a pole.

In U.S. Pat. No. 6,948,713 to Grunfeld, a disc golf target using a chain and net assembly including an upper chain and net ring with ring sleeve is received on top of the upper pole for suspending the assembly. The upper chain and net ring is used for suspending a plurality of chains and a net. A weighted lower chain and net ring is attached to a bottom of the chains and the net. The lower chain and net ring includes a floating sleeve. When a flying disc hits the chains and/or the net, the floating sleeve acts as a shock absorber. Grunfeld also notes that his disc golf target is "portable, lightweight, rugged in construction and can be quickly assembled and disassembled" even though it is constructed to include heavy chains.

In U.S. Pat. No. 6,554,285 to Chittenden, a disc golf target is described as using a plurality of chain segments suspended from a support member by generally U-shaped attachment loops. The attachment loops have upwardly and outwardly sloped side portions, so that the energy of the disc is absorbed and dissipated by spreading and lifting the chain segments as the disc strikes the target assembly. In U.S. Pat. No. 6,250,635 also to Chittenden, a disc golf target is described using chains supported from curved support members. The curved support members are disposed above a disc-receiving basket mounted on an upright stand. In U.S. Pat. No. 5,921,551 to Dunipace, another disc golf target is disclosed having a chain rack. The chain rack is used to suspend a plurality of outer and inner chains. The chains are disposed above a pole mounted basket. In U.S. Pat. No. 5,358,255 to Jolsen, a disc catching apparatus is illustrated having flexible chains, an open top basket and a top housing having one or more lamps. The lamps are used to light up the disc catching apparatus.

However, none of the conventional flying disc targets above solve the problem of creating a lighter and more portable disc golf target that still provides an effective target for trapping the flying discs. The heavy chains of these conventional flying disc targets limit their use as portable flying disc targets.

SUMMARY

In view of the foregoing, it is a primary objective of the subject invention to provide an improved flying disc target assembly that is lighter and more portable than traditional disc golf targets while still effectively engaging and stopping the flight of a flying disc and dropping the disc by gravity into an open top basket. The basket is formed in two pieces and fits around and mounts on an upright vertical pole.

Another object of the invention is the use of a combination of a plurality of string and plastic beads in place of the conventional chains or chain net combinations in conventional flying disc golf targets. The string and beads are connected to a weighted metal ring that surrounds the pole and lifts up slightly as a disc strikes the beads and string. The string and beads are used for interfering with the motion of the flying disc and causing the metal ring to lift as a means to dissipate the kinetic energy of the flying disc. Then, the flying disc either remains entrapped in the string and beads or falls into the open top basket. Contrary to the teachings of the prior art, the string and beads are very light weight and do not provide significant dissipation of kinetic energy themselves. Most of the kinetic energy transferred from the disc is dissipated in lifting the metal ring attached to the bottom of the string and beads.

Contrary to other disc golf targets that claim to be lightweight such as found in U.S. Pat. No. 6,948,713, the present disc golf target is significantly lighter because metal is used as a construction material only where reasonably necessary to provide required structural integrity (such as in the frame, basket, and bead and string support means that will undergo significant stress). Accordingly, the present disc golf target is significantly lighter than other flying disc golf targets of similar durability because heavy chains are not used. Even though the "weighted ring" does contribute some weight to the disc golf target, the "weighted ring" is still relatively lightweight while providing sufficient weight to dissipate the energy from a flying disc.

Many prior art systems place all or most of the weight in the chains such that a similar process occurs but the object being lifted or moved are the chains themselves and not a weighted ring. Other prior art systems use chains in combination with weighted rings. In either case, many of the heavy chains are not used each time a disc hits the target. If the disc hits and lifts or moves one or two chains, the remaining chains are not being utilized in the energy dissipation. Both of these methods result in an overly heavy disc golf target that is not easily portable.

The present invention resolves this problem by devising the current bead and string system to use lightweight beads and string in combination with a single weighted ring. This provides the same advantages of prior art systems, i.e., the flying disc is forced to convert its kinetic energy into gravitational potential energy, without the disadvantages of significant amounts of unnecessary weight that is not used with each disc that strikes the target. With the present system, a single weighted member (the weighted ring) is used for energy dissipation no matter which string and bead loop the disc hits. This provides a portable disc golf target that is very effective while minimizing the weight of the target. Prior art systems do not have this high level of portability and effectiveness because the chains are overly heavy and prevent the disc golf target from being easily transported.

To further enhance portability, the current disc golf target is supported by a tripod type device having four folding legs instead of three (a "quadpod"). This tripod type device with four folding legs will be referred to as a quadpod herein for simplicity.

In one embodiment, a portable flying disc game includes a foldable base that is positionable between an open position and a closed position; a vertical pole, the foldable base being pivotally attached to a first end of the vertical pole; and a first basket member that is removably coupled to the vertical pole above the foldable base. The first basket member includes a first part and a second part that are detachable from one another. The first part has a first coupling member that receives the vertical pole and permits the first basket member to slide vertically along the pole to a location where the first basket member is coupled thereto. The first coupling member includes a support flange for receiving and supporting the second part to form the assembled first basket member. The game also includes a second basket member that is removably coupled to the vertical pole. The second basket member includes a frame having a first part and a second part that are detachable from one another. The frame includes a number of attachment members to which ends of the cords are coupled to so that the cords hang from the frame; and a weighted member that is coupled to the cords which serve to support and suspend the weighted member above the first basket.

These and other objects of the present invention will become apparent to those familiar with various types of flying disc targets and flying disc golf when reviewing the following detailed description, showing novel construction, combination, and elements as herein described, it being understood that changes in the various embodiments of invention are meant to be included as coming within the scope of the invention, except insofar as they may be precluded by the prior art.

DETAILED DESCRIPTION OF THE PREFERRED EMBODIMENTS

Figure 1:
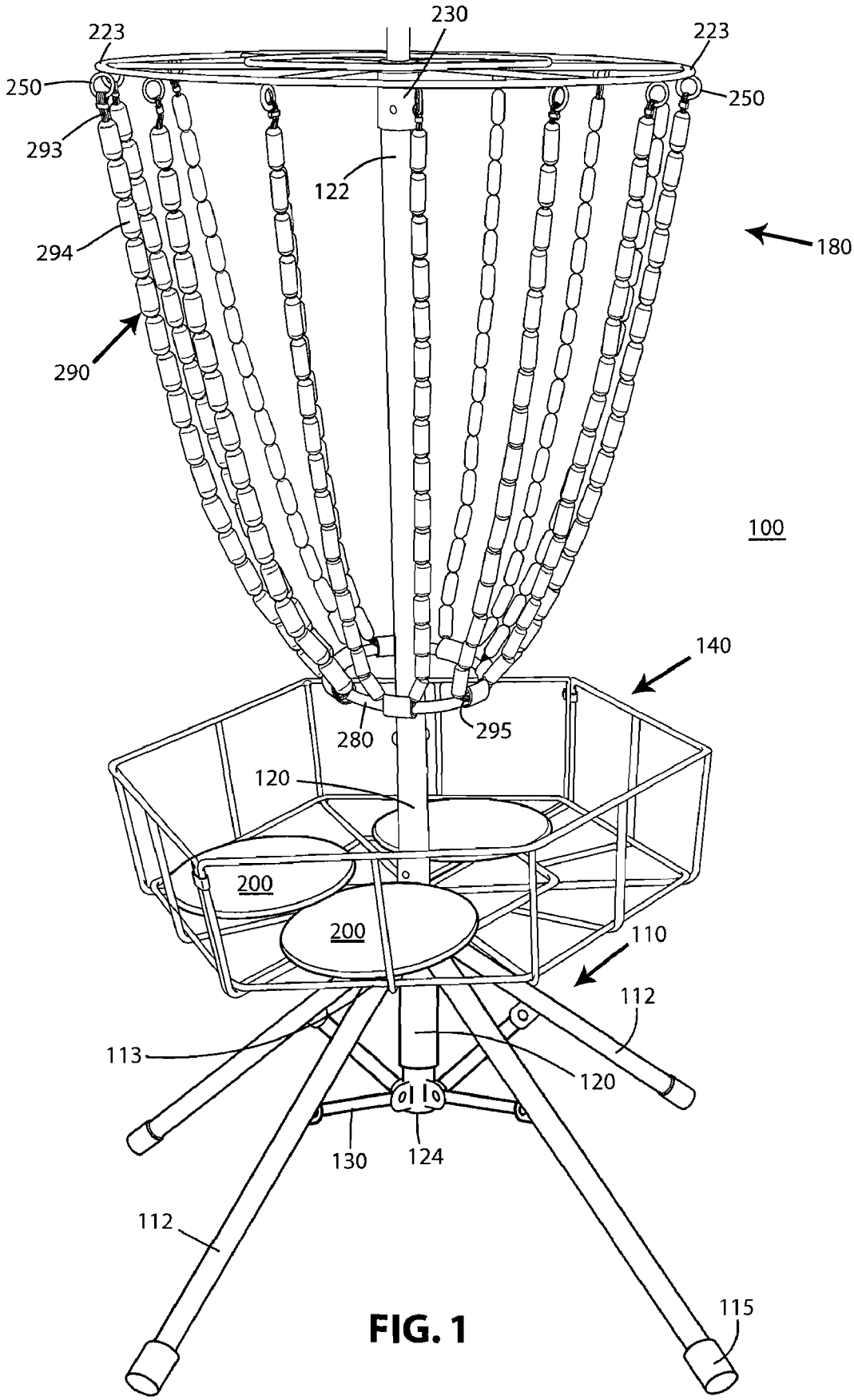
FIG. 1 is a perspective view of portable flying disc game ("disc golf") according to one embodiment.

FIG. 1 depicts a fully assembled portably flying disc target 100 according to one embodiment of the present invention. The portable flying disc target 100 is made up of a number of different components or parts that interact with one another to provide the illustrated game target.

More specifically, the portable flying disc target 100 includes a base section 110 that can be in the form of a tripod or quadpod folding stand 110 with a vertical pole 120 being attached to the quadpod stand 110. The quadpod stand 110 is effectively a tripod type stand having four legs 112 instead of three. This provides enhanced stability of the portable flying disc target 100 while still providing for a compact and portable stand 110. The legs 112 are in the form of elongated tubular rods or the like that are attached to the vertical pole 120 in a pivotable manner so that when the legs 112 are in the open position shown in FIG. 1, the legs 112 are angled relative to the pole 120. For example, first ends (top ends) 113 of the legs 112 can be attached in a pivotable manner to the pole 120 at one location and pivotable support fingers 130 that are pivotable attached to the legs 112 and pole 120 can be provided. The pivotable fingers 130 are attached to the legs 112 between the top ends 113 and bottom ends 115 thereof that are configured to sit on the ground for supporting the assembled target 100.

The vertical pole 120 can be a single pole or multiple smaller poles that fit together, such as a telescoping pole or one that is simple formed of a number of attached pole sections. One exemplary embodiment uses multiple shorter poles to increase the portability of the portable flying disc target 100 since the pole 120 can be broken down into a number of shorter pole sections that can be easily and more compactly stored.

The vertical pole 120 includes a top end 122 and an opposing bottom end 124. As shown in FIG. 1, the pivotable fingers 130 are pivotally attached to the bottom end 124 and the first ends (top ends) 113 of the legs 112 are located proximate but spaced from the bottom end 124.

The target 100 includes an open basket member 140 that is removably coupled to the vertical pole 120. As with the other components of the target 100, the basket member 140 is configured to be easily assembled and disassembled to permit easy and quick attachment to and removal from the vertical pole 120.

Figure 2:
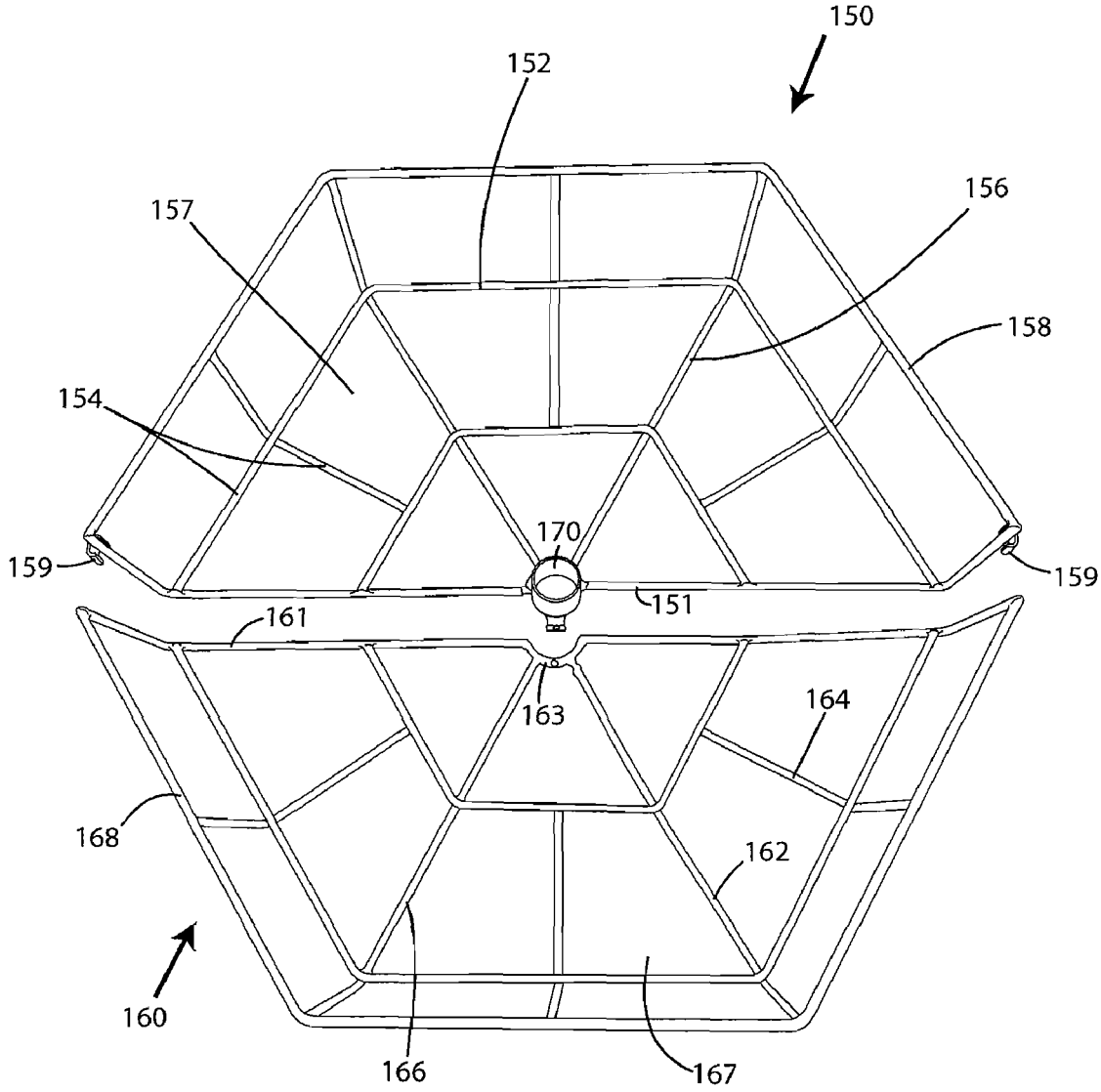
FIG. 2 is an exploded perspective view of bottom basket assembly.
Figure 3:
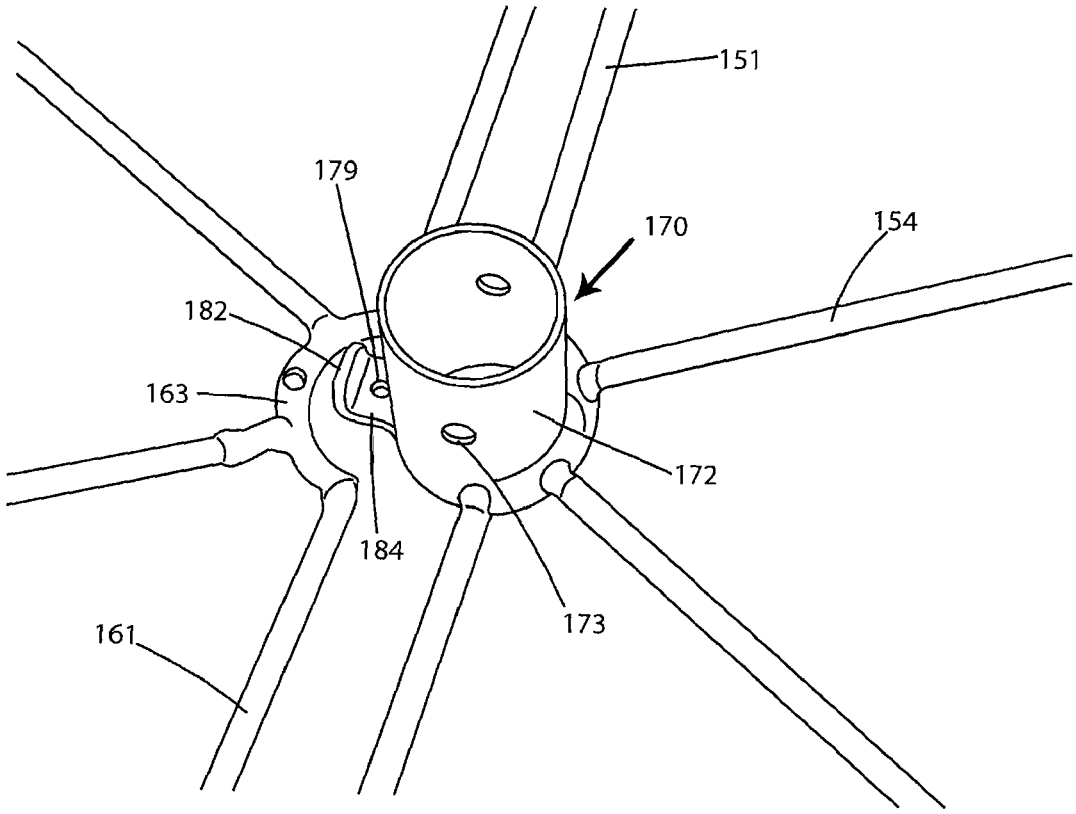
FIG. 3 is a partial perspective view of the locking/coupling components of the bottom basket assembly.

The basket member 140 illustrated in FIGS. 1-3 is formed of two parts, namely a first part 150 and a second part 160 that are configured to mate with one another to form the assembled basket member 140 shown in FIG. 1. The first and second parts 150, 160 can be thought of as being two halves of the basket member 140. The first part 150 is the part that is configured to engage and be coupled to the vertical pole 120. The first part 150 includes a frame 152 that is formed of a number of interconnected rails or bars 154 that are connected at various points to form the frame 152. Open spaces 157 are formed between the interconnected bars 154. The bars 154 of the frame 152 are arranged to define a floor section 156 and a side wall section 158 that extends radially outward from the peripheral edge of the floor section 156. In other words, the side wall section 158 is an upright structure that extends upwardly from the floor section 156. The side wall section 158 is thus angled relative to the floor section 156. For example, the side wall section 158 can be formed approximately perpendicular to the floor section 156; however, the side wall section 158 can be formed at another angle relative to the floor section 156. For example, an angle of less than 90 degrees or greater than 90 degrees can be formed between the side wall section 158 and the floor section 156. In the illustrated embodiment, the angle between the side wall section 158 and the floor section 156 is slightly greater than 90 degrees.

The spaces 157 have shapes and sizes that permit projectiles 200 to be received and contained within the basket member 140 without falling through the spaces 157 and onto the ground. In other words, the projectiles 200, when thrown, land within the basket member 140 which can represent a scoring event under one set of rules.

In the illustrated embodiment, the assembled basket member 140 has a hexagon shape and therefore, each of the first and second parts 150, 160 represents one half (½) of a hexagon.

The first part 140 includes a coupling member 170 that permits the first part 150 to be coupled to the vertical pole 120 and more specifically, the coupling member 170 permits the first part 150 to slidingly travel along and be coupled in place to the vertical pole 120. The coupling member 170 is located along an inner edge 151 of the first section 150 and is formed at a location where a number of bars 154 of the floor section 156 intersect one another. In the illustrated embodiment, the coupling member 170 includes a tubular structure 172 that is open at both ends and has a diameter that is complementary to the diameter of the section of the vertical pole 120 to which the basket member 140 is attached. More specifically, the diameter of the tubular structure 172 is selected so that at least a portion of the vertical pole 120 is received therein. In one embodiment, the tubular structure 172 slides over the vertical pole 120 and rests in a location that is above the portable, foldable stand 110.

In one embodiment, inner edge 151 intersects the tubular structure 172 at approximately its middle portion so that about one half of the tubular structure 172 extends outwardly from the inner edge 151. In other words, a semi-circular portion of the tubular structure 172 protrudes beyond the inner edge 151.

The tubular structure 172 can be coupled to the vertical pole 120 using any number of different means, including, but not limited, to using a frictional fit or a fastener. For example, the tubular structure 172 can include one or more openings 173 through which fasteners can be inserted for locking the first part 150 of the basket member 140 in place along the vertical pole 120. In addition, one section, such as the lower section, of the tubular structure 120 can include a flange on which the bottom end of the tubular structure 120 sits. The tubular structure 120 thus sits by gravity on the flange which restricts further downward movement of the basket member 140 on the vertical pole 120.

The coupling member 170 includes a flange or hook member 179 to permit the second part 160 to be coupled to the first part 150. The hook member 179 extends radially outward from the tubular structure 172 at one end (bottom end) 175. The hook member 179 in FIG. 3 is in the form of an L-shaped bracket with a vertical section 182 being parallel to and spaced from the tubular structure 172. A horizontal section 184 of the L-shaped bracket (hook) 179 extends outwardly from the tubular structure 172 and is perpendicular thereto. The latch member 179 is located in the semi-circular portion of the tubular structure 170 that extends beyond the inner edge 151.

Similar to the first part 150, the second part 160 includes a frame 162 that is formed of a number of interconnected rails or bars 164 that are connected at various points to form the frame 162. Open spaces 167 are formed between the interconnected bars 164. The bars 164 of the frame 162 are arranged to define a floor section 166 and a side wall section 168 that extends radially outward from the peripheral edge of the floor section 166. In other words, the side wall section 168 is an upright structure that extends upwardly from the floor section 166. The side wall section 168 is thus angled relative to the floor section 166. For example, the side wall section 168 can be formed approximately perpendicular to the floor section 166; however, the side wall section 168 can be formed at another angle relative to the floor section 166. For example, an angle of less than 90 degrees or greater than 90 degrees can be formed between the side wall section 168 and the floor section 166. In the illustrated embodiment, the angle between the side wall section 168 and the floor section 166 is slightly greater than 90 degrees.

As with the spaces 157, the spaces 167 have shapes and sizes that permit projectiles 200 to be received and contained within the basket member 140 without falling through the spaces 167 and onto the ground.

The second part 160 has a complementary inner edge 161 that mates with the inner edge 151 of the first part 150 and the semi-circular portion of the tubular structure 172. Accordingly, the inner edge 161 includes a semi-circular portion 163 that mates with and receives the semi-circular portion of the tubular structure 172 that extends beyond the inner edge 151.

The diameter of the bars 164 of the second part 160 and in particular, the diameter of the inner edge 161 thereof, is sized so that it can be received in the space between the vertical section 182 and the tubular structure 172. More specifically, the inner edge 161 is nested between the vertical section 182 and the tubular section 172.

The semi-circular portion 163 is inserted into the space between the vertical section 182 and the tubular structure 172. In this manner, the second part 160 rests on and is supported by the first part 150 to form a complete open top basket 140 for catching the flying discs (projections 200). In its installed position, the basket 140 is disposed over the base stand 110.

The side wall section 158 of the first part 150 can also include additional coupling members 159 for coupling the second part 160 to the first part 150. The coupling members 159 can be in the form of hook members (e.g., U-shaped or C-shaped hooks) that receive and interlock with bars of the side wall section 168 of the second part 150.

To disassemble the basket 140, the second part 160 is merely lifted off the first part by disengaging the semi-circular portion 163 of the inner edge 161 from the latch member 170.

When assembled, the first and second parts 150, 160 form a hexagonally shaped basket member 140.

Figure 4:
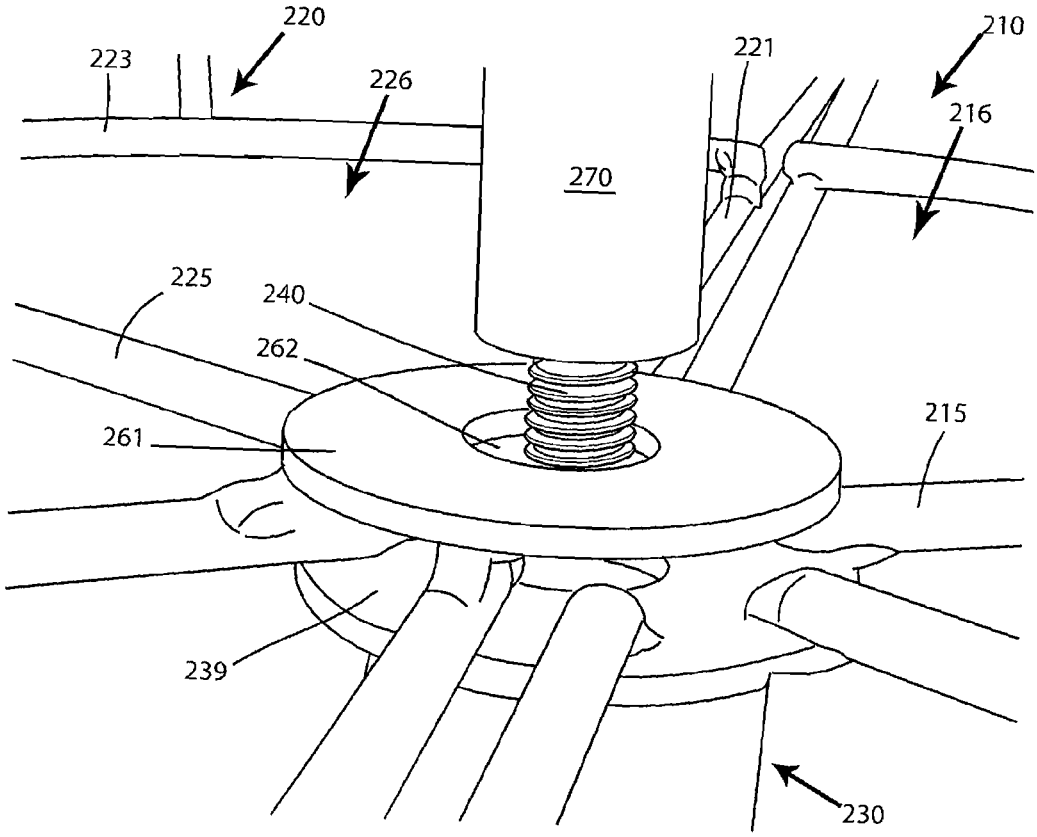
FIG. 4 is an exploded perspective view of a top basket assembly.
Figure 5:
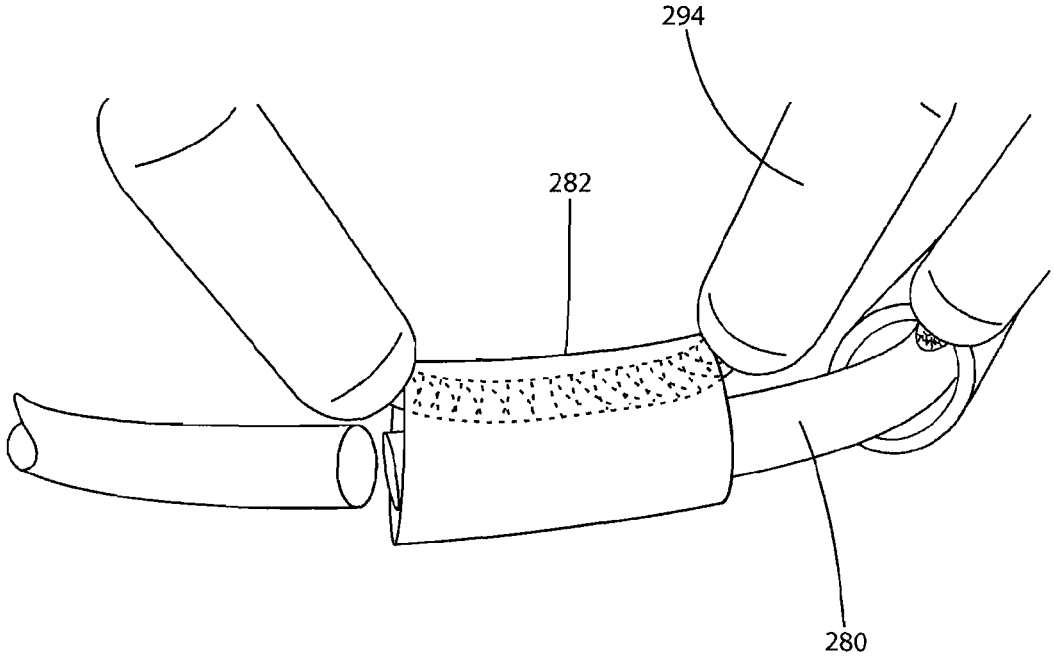
FIG. 5 is a cross-sectional ring of a weighted ring and looped bead structure that is attached to the upper basket assembly.

The target 100 includes a top assembly 180 that acts as another target (projectile 200) receiving member or structure, as well as acting as a target deflecting member as best shown in FIGS. 1 and 4-5. In one embodiment, the top assembly 180 is a string and bead assembly that slips over and is coupled to the vertical pole 120. The top assembly 180 can also be referred to as a second basket member that can receive and hold the thrown projectiles 200.

Similar to the basket 140, the illustrated top assembly 180 is formed of a first part 210 and a second part 220 that are easily assembled and disassembled to permit easy and compact storing of the components of the target 100. In contrast to the hexagonal shape of the basket 140, the top assembly 180 generally has a circular shape and therefore, the first part 210 has a semi-circular shape and the second part 220 has a semi-circular shape. The first part 210 includes a substantially linear inner edge 211 and a semi-circular outer peripheral edge 213 with radial spokes or bars 215 formed between the inner edge 211 and the edge 213. Spaces 216 are formed between the inner edge 211, bars 215, and edge 213.

Along the inner edge 211, e.g., in a middle portion thereof, the first part 210 includes a coupling member 230 for coupling the top assembly 180 to the vertical pole 120. The coupling member 230 can be in the form of a tubular structure that has an inner diameter that is sized to receive the vertical pole 120. The coupling member 230 is a closed structure to permit it to rest on the top (top end 122) of the vertical pole 120. The first part 210 is thus coupled to the top of the vertical pole 120 in any number of different ways, including inserting a portion (top end 122) of the vertical pole 120 into the bore of the closed ended coupling member 230. The first part 210 thus rests on and be supported by the top end 122 of the vertical pole 120.

A top surface or face 239 of the coupling member 230 includes a fastener element 240 (e.g., protrusion with screw threads) for coupling the second part 220 to the first part 210. The fastener element 240 thus extends outwardly from the top surface 239 away from the stand 110. The coupling member 230 can be the portion where the inner edge 211, bars 215, and edge 213 intersect and terminate.

It will be appreciated that the first part 210 is installed in an inverted manner on the vertical pole 120 in that the coupling member 230 faces down and extends toward the base stand 110 as shown in FIG. 1 and the fastening element 240 extends away from the vertical pole 120.

The peripheral edge 213 includes a number of attachment members 250 that are used to attach a number of cord members 290 that extend downwardly from the top assembly 180. The cord members 290 can be in the form of a plurality of string or cord members that include beads. For example, each cord member 290 includes a base string, rope or cord 292 and a plurality of beads 294 that are disposed about and along a length of the cord 292 by inserting the cord 292 through bores formed through the beads 294.

The attachment members 250 can be in the form of rings that are disposed, in a spaced manner, along the peripheral edge 213. First ends 293 of the cord 292 are attached to the attachment member 250 using conventional techniques, including tying the first ends 293 to the attachment members 250.

The second part 220 includes a substantially linear inner edge 221 and a semi-circular outer peripheral edge 223 with radial spokes or bars 225 formed between the inner edge 221 and the edge 223. Spaces 226 are formed between the inner edge 221, bars 225, and edge 223.

Along the inner edge 221, e.g., in a middle portion thereof, the second part 220 includes a coupling member 261 for coupling the second part 220 to the first part 210 and to the vertical pole 120. The coupling member 261 can be in the form of a disk that includes an opening 262. The opening 262 is shaped and sized to receive the fastener element 240 associated with the coupling member 230. Accordingly, the opening 262 can be a circular shaped opening. The coupling member 261 is also sized so that it can sit on and be supported by the coupling member 230.

The first and second parts 210, 220 are secured to one another by using a fastener 270. For example, the fastener 270 can be a threaded fastener, such as a bolt, that is complementary to the threaded fastener 240. By threadingly attaching the fastener 270 to the fastener 240, the first and second parts 210, 220 are securely attached to one another.

The peripheral edge 223 includes a number of attachment members 250 that are used to attach the cord members 290 that extend downwardly from the top assembly 180. The attachment members 250 can be in the form of rings that are disposed, in a spaced manner, along the peripheral edge 223. First ends 293 of the cord 292 are attached to the attachment member 250 using conventional techniques, including tying the first ends 293 to the attachment members 250.

Figure 6:
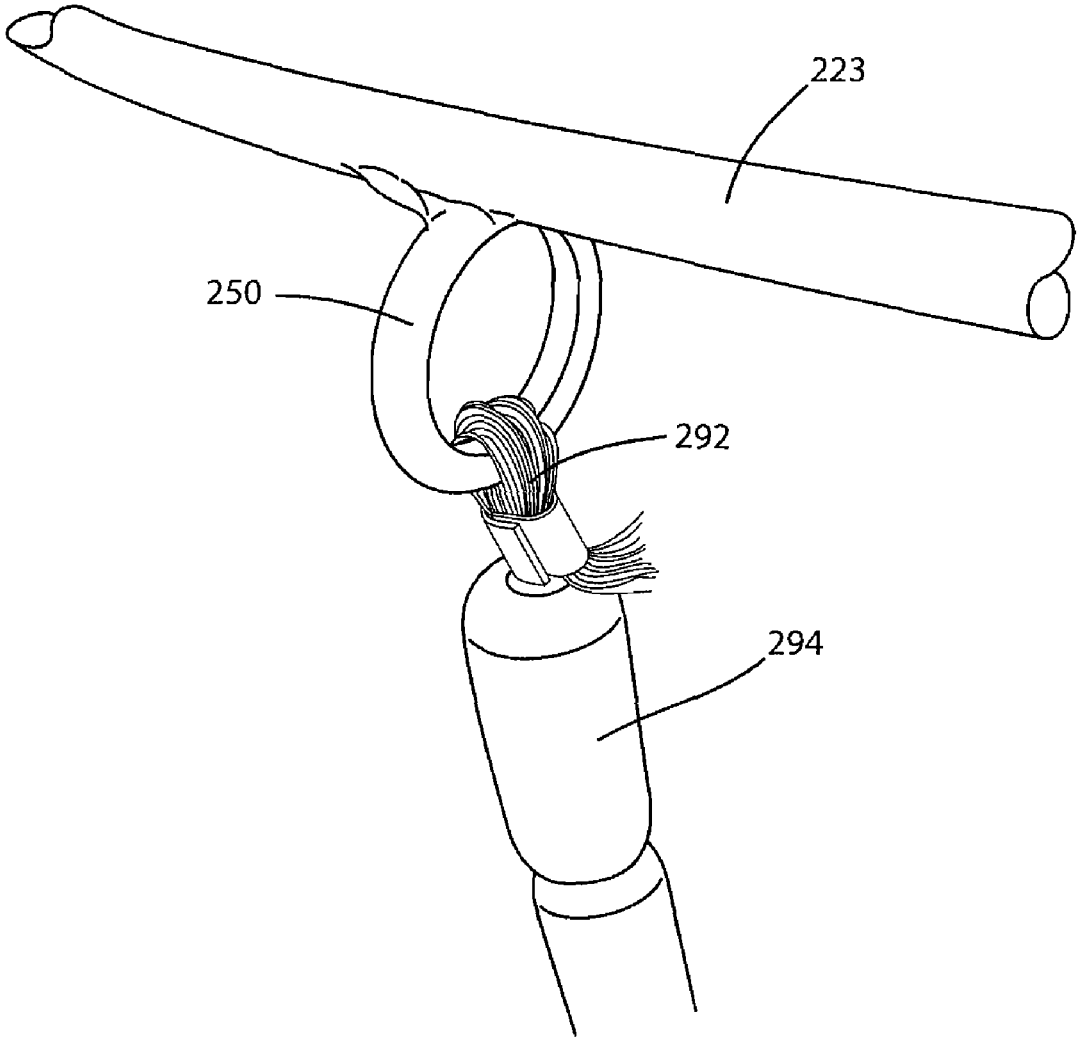
FIG. 6 is a close-up perspective view of the looped beaded structure attached to the top basket assembly.

The top assembly 180 also includes a weighted member 280, such as a weighted ring, that is attached to the looped bottom ends 295 of the cords 292 as shown in FIG. 6. In particular, the weighted member 280 includes a coupling member 282 that serves to attach the looped cord 292 to the weighted member 280. The coupling member 282 can be in the form of a sleeve that surrounds the weighted member and a space is provided between the weighted ring 280 and the inner surface of the coupling member 282 for receiving the cord 292. In this manner, the cord 292 is effectively threaded through the sleeve 282, thereby coupling the looped cord 292 to the attached weighted ring 280. The coupling member 282 is thus similar to bead 294; however, the bore formed therein is much larger since not only is cord 292 received but also the weighted ring 280 is received.

In other words, the coupling member 282 can have a tubular constructions with the weighted ring 280 being received therein.

Once the basket 140 is installed, the top assembly 140 (string and beads assembly) slips over the vertical pole 120 by first slipping the weighted ring 280 over the vertical pole 120 and then installing the lower half (first part 210) of the string and bead support (top assembly 180) by sliding the coupling member 230 over the top of the vertical pole 120. The lower half (first part 210) of the string and bead support 180 rests at the top of the vertical pole to maintain the proper position. The second half (second part 220) of the string and bead support (top assembly 180) then rests on the first half (first part 210) of the string and bead support 180 similar to the way the open basket 140 fits together. When both halves 210, 220 of the string and bead support 180 are installed, a circular shaped structure with support spokes is formed. By using a two-piece string and bead support 180 and two-piece basket 140, the disc golf target 100 can be packed up into a more compact form for portability.

The string and bead assembly 180 is placed on the top of the pole as described above. The string and bead assembly 180 is normally substantially assembled prior to placement on the vertical pole 120 although that is not critical to the invention. The weighted ring 280 slides over the vertical pole 120 to rest near the open top basket 140 and then the assembled first and second parts 210, 220 are slid over the top of the pole 120 and held in place.

As best shown in FIGS. 5 and 6, the string and bead assembly 180 is designed such that for each loop, a length of string or cord 292 forms a vertical loop with the top 293 of the loop being attached to the string and bead support 180 and the bottom 295 of the loop 292 being attached to the weighted ring 280. The bottom of the vertical loop 292 is loosely attached to the weighted ring 280 and the top two portions of the string 292 are attached to the string and bead support 180. Virtually the entire loop of string 292 is covered in plastic beads 294 to protect the string 292 and provide more impact surface area for the flying discs 200. The combination of multiple loops connected to both the string and bead support frame 180 and the weighted ring 280 forms a generally inverted conical shape.

By attaching each vertical loop of string 292 to the weighted ring 280, the kinetic energy of the flying discs 200 must be used to lift the weighted ring 280 resulting in much less energy within the flying disc 200. This causes the flying disc 200 to be entrapped within the string and beads 292 or fall into the open top basket 140. The weighted ring 280 is generally smaller than the string and bead support 180 so as to create an inverted conical shape from the string 292 and beads 294. This acts to direct the flying discs 200 into the open top basket 140.

Any number of string and bead loops can be used depending on the size of the target and the size of the discs 200 to be used. More loops will result in fewer gaps and a better trapping of the discs. Fewer loops may make it more difficult to trap a disc. Simple experimentation can be used to determine the optimum number of string and bead loops for a particular type of disc. By way of example, but not limitation, seven loops of string approximately equally spaced around a circular string and bead support provides satisfactory results for a target of the following approximate dimensions:

Circular string and bead support (top assembly 180): 24" diameter

String (cord 292) length: 56"

Weighted ring (280): 7" diameter

Octagonal open top basket (140): 24" across

Height from ground to circular string and bead support (top assembly 180): 54"

Height from bottom of basket (140) to circular string and bead support (top assembly 180): 35"

Disc diameter (200): 8-9"

When a flying disc 200 contacts the assembled disc golf target 100, specifically, the string 292 and beads 294, the string 292 and beads 294 generally move back making the string shorter. This causes the weighted ring 280 to lift up and converts the kinetic energy of the flying disc 200 to gravitational potential energy in the weighted ring 280. The weighted ring 280 then returns to its original position dissipating the gravitational potential energy. At this point, the flying disc either becomes entrapped within the inverted conical shape formed by the string 292 and beads 294 or falls into the open top basket 140. In many cases, the inverted conical shape provides the added benefit of directing the flying disc 200 toward the basket 140 below.

While the invention has been particularly shown, described and illustrated in detail with reference to the preferred embodiments and modifications thereof, it should be understood by those skilled in the art that equivalent changes in form and detail may be made therein without departing from the true spirit and scope of the invention.

What is claimed is:

1. A portable flying disc game comprising:

a foldable base that is positionable between an open position and a closed position;

a vertical pole, the foldable base being pivotally attached to a first end of the vertical pole;

a first basket member that is removably coupled to the vertical pole above the foldable base, the first basket member includes a first part and a second part that are detachable from one another, the first part having a first coupling member that receives the vertical pole and permits the first basket member to slide vertically along the pole to a location where the first basket member is coupled thereto, the first coupling member including a support flange for receiving and supporting the second part to form the assembled first basket member;

a second basket member that is removably coupled to the vertical pole, the second basket member including a frame having a first part and a second part that are detachable from one another, the frame including a number of attachment members to which ends of cords are coupled to so that the cords hang from the frame; and a weighted member that is coupled to the cords which serve to support and suspend the weighted member above the first basket.

2. The game of claim 1, wherein the foldable base comprises three or more legs that are pivotally attached to the vertical pole, the legs being angled relative to one another in the open position and substantially parallel to one another in the closed position.

3. The game of claim 2, wherein the foldable base comprises a quadpod having four pivotal legs.

4. The game of claim 1, wherein each of the first and second parts of the first basket member includes a frame formed of a number of interconnected bars, with open spaces being formed between the bars.

5. The game of claim 4, wherein each frame includes a floor section and an upstanding peripheral wall structure extending upwardly from the floor section.

6. The game of claim 4, wherein the first coupling member is located along an inner edge of the frame of the first part of the first basket member and comprises a tubular structure that receives the vertical pole to permit the first basket member to slidingly travel along the length of the vertical pole.

7. The game of claim 6, wherein the support flange comprises an L-shaped bracket with a vertical section being spaced from and parallel to the tubular section.

8. The game of claim 7, wherein the frame of the second part of the first basket member includes an inner edge that is removably received in the L-shaped bracket and held within the space between the vertical section and the tubular section.

9. The game of claim 4, wherein an inner edge of the frame of the second part of the first basket member includes a semi-circular shaped section that is disposed about the first coupling member that is in the form of a circular tubular structure.

10. The game of claim 4, wherein inner edges of the frames of the first and second parts of the first basket member are disposed adjacent one another and the assembled first basket member has a hexagonal shape.

11. The game of claim 5, wherein the upstanding peripheral wall structure of the first part of the first basket member has a pair of hook members for receiving and retaining the peripheral wall structure of the second part of the first basket member when the first and second parts are mated to one another.

12. The game of claim 1, wherein the second basket member comprises a net structure formed of looped cords.

13. The game of claim 12, wherein each looped cord includes a plurality of beads that are disposed over the cord, free ends of each looped cord being attached to the attachment members and being coupled to the weighted member.

14. The game of claim 1, wherein the weighted member comprises a weighted disc.

15. The game of claim 14, wherein each cord is looped so that each of its free ends is attached to the attachment members and a looped portion of the cord extends through a second coupling member that is attached to the weighted disc, thereby attaching the cord to the weighted disc.

16. The game of claim 15, wherein the second coupling member is a sleeve member that surrounds the weighted disc with the looped portion being disposed between the sleeve and the weighted disc.

17. A portable flying disc game comprising:

a foldable base that is positionable between an open position and a closed position;

a vertical pole, the foldable base being pivotally attached to a first end of the vertical pole;

a first basket member that is removably coupled to the vertical pole above the foldable base, the first basket member includes a first part and a second part that are detachable from one another and can be pre-assembled, the first part having a first coupling member that receives the vertical pole and permits the first basket member to slide vertically along the pole to a location where the first basket member is attached thereto, the first coupling member including a retaining element extending radially outward therefrom for receiving and supporting the second part to form the assembled first basket member;

a bead assembly that is removably coupled to the vertical pole above the first basket member, the bead assembly including a support base having a frame formed of a first part and a second part that are detachable from one another and can be pre-assembled, the frame including a number of attachment members to which ends of looped cord structures are attached to so that the cord structures hang from the frame, each cord structure including a cord to which a plurality of beads are slidingly attached; and a weighted member that is coupled to looped end portions of the cord structures which serve to support and suspend the weighted member above the first basket member.

* * * * *